US005829533A

United States Patent [19]

Williams

[11] Patent Number: 5,829,533

[45] Date of Patent: Nov. 3, 1998

[54] METHOD FOR EXTINGUISHING TANK FIRES, IN PARTICULAR FOR CRUDE AND HIGH VAPOR PRESSURE FLAMMABLE LIQUID

[75] Inventor: Dwight Williams, Vidor, Tex.

[73] Assignee: Williams Fire & Hazard Control, Inc., Mauriceville, Tex.

[21] Appl. No.: 685,701

[22] Filed: Jul. 23, 1996

Related U.S. Application Data

[63] Continuation-in-part of Ser. No. 427,360, Apr. 24, 1995, Pat. No. 5,566,766.

[51] Int. Cl.[6] ..... A62C 3/06

[52] U.S. Cl. ..... 169/46; 169/66; 169/68

[58] Field of Search ..... 169/46, 47, 66, 169/67, 68

[56] References Cited

U.S. PATENT DOCUMENTS

| | | | |
|---|---|---|---|
| 1,775,846 | 9/1930 | Blaw | 169/67 |
| 2,725,943 | 12/1955 | Grossheim | 169/67 |
| 4,781,252 | 11/1988 | Wilburn et al. | 169/66 |
| 5,240,078 | 8/1993 | Worthington | 169/67 |
| 5,566,766 | 10/1996 | Williams | 169/46 |

FOREIGN PATENT DOCUMENTS

| | | | |
|---|---|---|---|
| 1248613 | 8/1986 | U.S.S.R. | 169/68 |
| 1597201 | 10/1990 | U.S.S.R. | 169/68 |
| 1606132 A | 11/1990 | U.S.S.R. | 169/66 |
| 1695947 A | 12/1991 | U.S.S.R. | 169/47 |
| 1824201 A1 | 6/1993 | U.S.S.R. | 169/47 |

OTHER PUBLICATIONS

"New Technique for Fighting Oil Fires," Scientific American, p. 256, Mar. 1928.

*Primary Examiner*—Gary C. Hoge
*Attorney, Agent, or Firm*—Sue Z. Shaper; Butler & Binion, L. L. P.

[57] ABSTRACT

A method for extinguishing flammable and combustible liquid tank fires using foam comprising empirically determining a footprint for a plurality of nozzles and configuring and aiming nozzles with respect to a tank such that predicted footprint and foam run would cover a tank surface with foam. Also method and apparatus for extinguishing tank fires including crude and high vapor pressure flammable liquid tank fires that includes applying foam in a footprint to cover liquid surface and cooling portions of the tank wall.

9 Claims, 12 Drawing Sheets

SQ. FT. = 39,741
APPLICATION DENSITY RATE = .18
MINIMUM APPLICATION = 7,153 GPM
FLOW = 7,000 GPM

SQ. FT. = 39,741
APPLICATION DENSITY RATE = .15
MINIMUM APPLICATION = 5,961 GPM
FLOW = 6,000 GPM

SQ. FT. = 49,063
APPLICATION DENSITY RATE = .16
MINIMUM APPLICATION = 7,850 GPM
FLOW = 8000 GPM

SQ. FT. = 49,063
APPLICATION DENSITY RATE = .2
MINIMUM APPLICATION = 9,813 GPM
FLOW = 10,000 GPM

SQ. FT. = 59,366
APPLICATION DENSITY RATE = .202 (ACTUAL)
MINIMUM APPLICATION = 11,992 GPM
FLOW = 12,000 GPM

SQ. FT. = 51,045
APPLICATION DENSITY RATE = .235
MINIMUM APPLICATION = 11,996 GPM
FLOW = 12,000 GPM

SQ. FT. = 75,926
APPLICATION DENSITY RATE = .21
MINIMUM APPLICATION = 15,944 GPM
FLOW = 16,000 GPM

SQ. FT. = 75,926
APPLICATION DENSITY RATE = .24
MINIMUM APPLICATION = 18,222 GPM
FLOW = 18,000 GPM

SQ. FT. = 93,435
APPLICATION DENSITY RATE = .21
MINIMUM APPLICATION = 19,621 GPM
FLOW = 20,000 GPM

SQ. FT. = 82,916
APPLICATION DENSITY RATE = .24
MINIMUM APPLICATION = 19,900 GPM
FLOW = 20,000 GPM

SQ.FT. = 93,435
APPLICATION DENSITY RATE = .256
MINIMUM APPLICATION = 23,920 GPM
FLOW = 24,000 GPM

SQ.FT. = 93,435
APPLICATION DENSITY RATE = .3
MINIMUM APPLICATION = 28,031 GPM
FLOW = 28,000 GPM

FIG. 3A
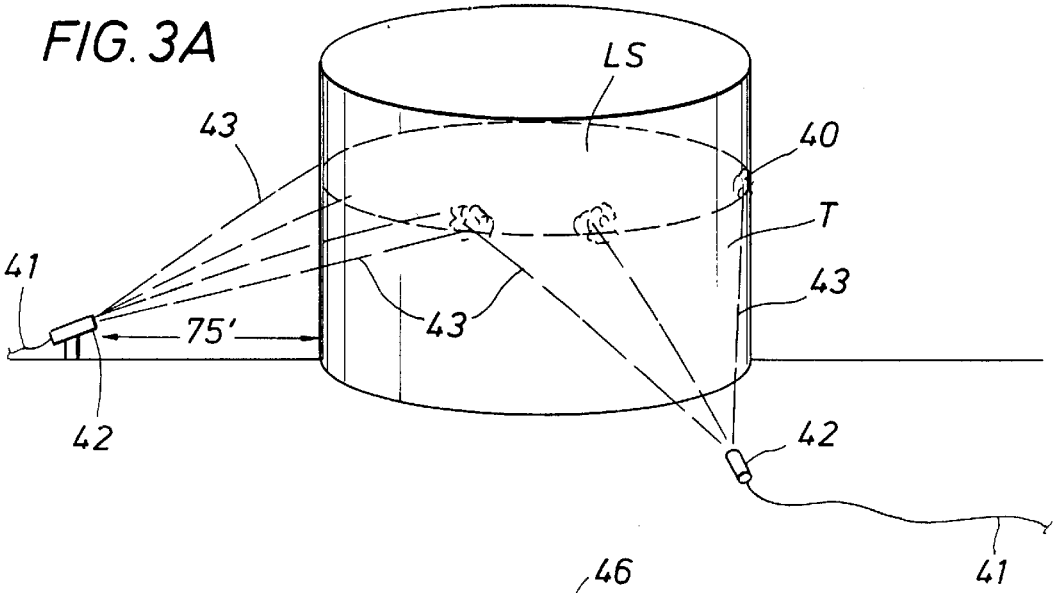
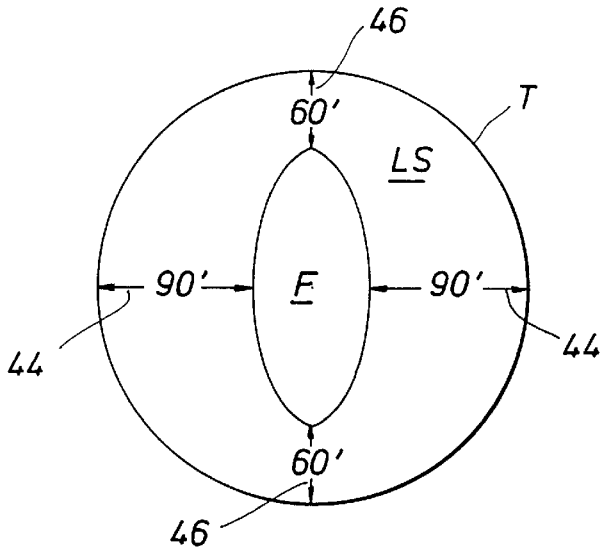
FIG. 3B
FIG. 3C
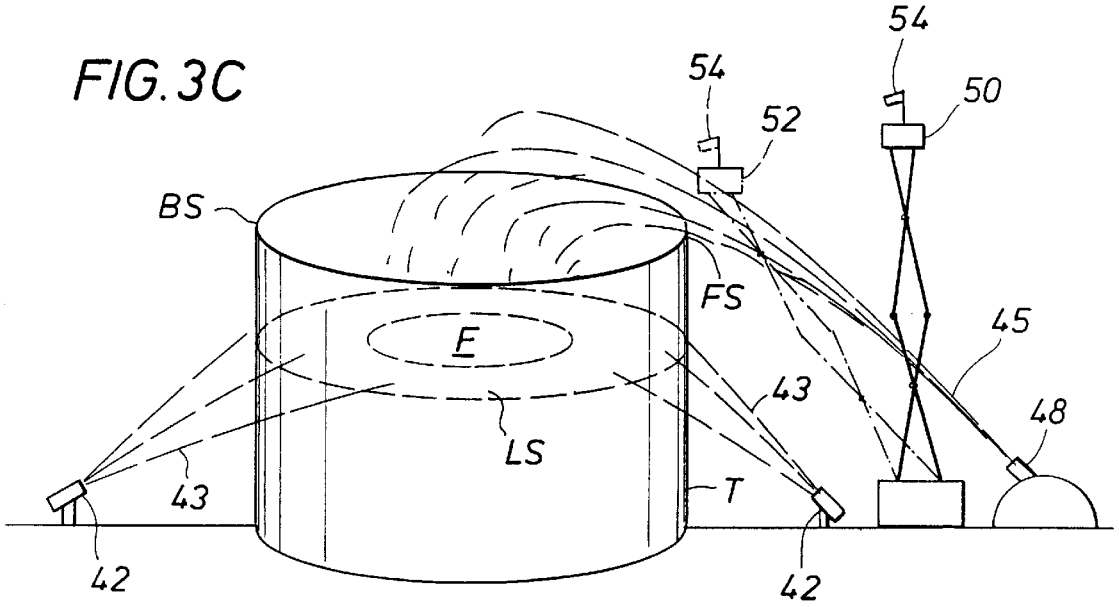

METHOD FOR EXTINGUISHING TANK FIRES, IN PARTICULAR FOR CRUDE AND HIGH VAPOR PRESSURE FLAMMABLE LIQUID

This application is a continuation-in-part of my prior application, Ser. No. 08/427,360, now U.S. Pat. No. 5,566,766, entitled "Method for Extinguishing Tank Fires".

FIELD OF INVENTION

This invention relates to a method for extinguishing flammable and combustible liquid tank fires using foam. In particular, the invention applies to crude and high vapor pressure flammable liquids.

BACKGROUND OF INVENTION

The past 18 years has witnessed several changes in the fire fighting industry. Foam delivery nozzles have enlarged their capacity from 500–1,000 gpm to 6,000–10,000 gpm, or higher. Fire hoses have increased in size from 2½" diameters to 5"–10" diameters. Foam pumper capacity has gone from 1,000 gpm to 2,500–6,000 gpm. Importantly, storage tanks for flammable and combustible liquids have increased in size dramatically from 125–150 feet diameter to 300–345 feet diameters.

Fire fighting procedures in the last eighteen years have also changed. A popular historic approach to extinguish a tank fire containing combustible or flammable liquid was to "surround and drown." Too often, however, the fire did not go out. The present inventor became one of the first in the field to recognize, through the review of numerous videos of tank fires, that foam, under the "surround and drown" system, was not reaching the full surface of the tank. The apparent reason was that the fire was "breathing", and in particular, there was an area, which came to be labeled the sweet spot, where the fire was taking in air (oxygen). Adjacent this sweet spot the fire would pulsatingly flame. A combination of sweet spot, breathing and thermal drafts was driving foam back and away from the middle of the tank surface.

Experience showed that the sweet spot typically lay just off of the center of the tank, and extending upwind approximately to the tank wall. For a variety of considerations, fire fighting nozzles are also upwind of the tank. The present inventor lead the field in revising techniques so that foam came to be applied predominantly toward the sweet spot.

For every tank size N.F.P.A. specifies a minimum "application density rate." Multiplying the square foot surface of a tank times the minimum "application density rate" yields a required minimum number of gallons per minute of foam that is to be applied. N.F.P.A. also specifies a minimum application time, e.g. 65 minutes. Applying the minimum g.p.m. foam for the minimum time should extinguish a tank fire. It became the present inventor's further experience, however, that applying a minimum gpm for the minimum time did not always lead to the extinction of a tank fire, even with foam applied predominantly to a sweet spot.

The above discovery led to the present invention. The inventor can demonstrate to the industry, in contrast to conventional wisdom, that each nozzle lays down a distinct footprint of foam. Conventional wisdom only considered it significant to measure a nozzle's maximum reach. The present inventor also teaches that foam has a "maximum run" on the top of flaming fluid. Maximum run is determined empirically to be approximately 100 feet. Putting together the above two discoveries, it can be demonstrated that if predicted footprints of foam require foam to "run" over 100 feet to completely cover a tank surface then notwithstanding applying a minimum, or even well over a minimum, "gallons per minute", and regardless of directing a significant amount of foam to the sweet spot, there will be areas of the tank that will not receive foam and there is some likelihood the fire will not go out.

As a result of the above discoveries, the present inventor teaches a method for configuring nozzles at a burning tank such that they not only satisfy the minimum application density rate prescribed by N.F.P.A. and cover the sweet spot, but they also provide, taking footprints and foam run limitations into account, a foam run to all of the walls of the tank. To so configure nozzles, the inventor empirically determines a footprint for each size of nozzle potentially usable.

The inventor's method can be used in designing for a fixed placement of nozzles in a dike system, permanently installed surrounding a tank, and/or for staging mobil nozzles around a burning tank.

Tank fires involving in particular crude and high vapor pressure flammable liquids may present special extinguishing problems beyond those discussed above. Though foam is applied in a footprint such that the liquid surface is covered by foam run to all sides of the tank; and though a prescribed minimum density of foam is applied for a minimum application time; a fire in a tank of in particular crude or high vapor pressure flammable liquid may yet not be extinguished. Experience indicates that even though a relatively thick layer of foam covers the liquid surface extending to the tank walls, the heat of a tank wall may cause in particular crude or high vapor pressure flammable liquid to boil. This boiling or vaporizing of the liquid at the tank wall can prevent the foam in place from extinguishing the fire.

The present inventor has developed an improved fire extinguishing system that promises even more effective treatment of tank fires, especially those involving crude and high vapor pressure flammable liquids, than application of a footprint system alone. The improved system includes, in addition to applying foam to the liquid surface having a footprint such that foam run covers the surface to the wall, the further step of applying a cooling fluid, such as water, against portions of the exterior tank wall, in particular at a height at and/or slightly above the liquid level, to cool the tank wall.

Under the improved system, when managing resources at a fire, and in particular when managing available water pressure, resources should first be deployed to establish a foam footprint such that foam run covers the liquid surface. (Note: Footprint is used here in the singular for convenience. It should be understood that "footprint" may refer to a plurality of footprints, established from plural sources.) Furthermore, cooling the upper tank wall prior to a foam attack could be a waste of resources, or even counter productive, because cooling the upper wall may cause the steel to draw and curl inward. A curling inward of the top of the wall could complicate the process of establishing foam coverage. To the extent fluid resources or water is available after establishing the foam attack, including most particularly water pressure, a portion of the tank wall should be cooled at and slightly above the liquid level. The cooling is advantageously begun at the side of the tank wall having the longest foam run. Alternatively, a backside portion of the tank wall, the backside being the downwind side, is best cooled first. Preferably, a full circumferential portion of the tank wall is cooled, extending from the liquid level height up approximately 3 feet. Oscillating monitors stationed around a tank can be located to have the requisite throw to cover the circumference of the tank wall, resources permitting.

A further strategy in cost-effectively extinguishing tank fires, and in particular crude and high vapor pressure flammable liquid tank fires, includes positioning a dry powder nozzle over a tank sidewall portion. Preferably, the nozzle would be positioned over a front portion of the tank wall, the front being the upwind side. A preferred nozzle would include both foam and dry powder capacity. The nozzle would be remotely controlled.

SUMMARY OF THE INVENTION

A method is disclosed for assisting in extinguishing flammable and combustible liquid tank fires using foam. Footprints for a plurality of potentially configured nozzles are empirically determined through shooting foam from the nozzles onto a grid. Nozzles are then configured around a tank such that predicted footprint, adjusted for the height of liquid in the tank, will cover a tank surface with foam under the limitations of maximum foam run.

An improved method is also disclosed for extinguishing tank fires including crude and high vapor pressure flammable liquid tank fires. This method includes applying foam to a liquid surface in a tank with a footprint such that foam run covers the liquid surface, and applying cooling fluid against at least a portion of the exterior tank wall at a height at and/or slightly above the liquid level, to cool the tank wall. In the absence of the ability or the resources to apply fluid to cool a full circumferential portion of the tank wall, or prior to when such resources can be fully in place, preferred embodiments include first applying fluid against a portion of the tank wall having the longest foam run. Alternatively, preferred embodiments include first applying fluid against a backside portion of the tank wall. Three feet has been found to be an approximate advantageous height above the liquid level at which to apply the cooling fluid. Oscillating monitors can be advantageously staged around the tank to throw water on the requisite portions of the tank wall. In some cases it is also advantageous to position a dry powder nozzle, or a foam and dry powder nozzle combination, above a tank side wall. A frontside portion of the tank wall would preferably be selected. The nozzle can be remotely positioned and operated through use of an extendable platform or boom.

BRIEF DESCRIPTION OF THE DRAWINGS

A better understanding of the present invention can be obtained when the following detailed description of the preferred embodiment is considered in conjunction with the following drawings, in which:

FIGS. 3A through 3C illustrate details of an improved method for extinguishing tank fires, including crude and high vapor pressure flammable liquid tank fires.

DETAILED DESCRIPTION OF PREFERRED EMBODIMENT

Each fire fighting nozzle, it has been discovered, and the present invention teaches, will lay down a characteristic footprint of foam in standard operation. Although flammable and combustible liquid tanks vary in diameter, they share an approximate common height, 50 feet (45 feet to 70 feet). Nozzle footprint studies can be run assuming a supply of a standard minimum water pressure, usually 100 psi, but possibly up to 125 psi, with the nozzles pointed in a standard inclination to the horizon. Given standard pressure, a nozzle and a particular foam concentrate, metered at an appropriate level, will have associated with it a characteristic "throw footprints". This footprint can be measured empirically by shooting the nozzle toward a grid laid out above the ground in a tank at an appropriate distance away. The observed mark of the perimeter of the foam on the grid describes the nozzle's footprint. Theoretical adjustments can be made for an increase or decrease in footprint due to potential height of liquid in a tank.

Experience and study show in addition that a given foam will run a limited distance over flaming liquid. The inventor empirically determines that maximum flow run for a foam.

Fire fighting nozzles are advantageously staged upwind of a burning tank. The sweet spot of the burning tank, that is the spot where the burning fluid appears to take in air, usually lies between the wall and the center of the tank in the upwind direction. Approximately 125 feet comprises a standard distance for configuring nozzles from a burning tank wall.

Each tank diameter has an application density rate prescribed by NFPA. Multiplication of the minimum application density rate times the square feet of surface area of the tank yields a minimum application rate of foam in gallons per minute.

The invention comprises a method for configuring nozzles from a tank such that their total gpm yields the minimum application gpm, their footprints tend to concentrate foam upon a predicted sweet spot of the tank while the combination of footprints does not require foam to run greater than an empirically estimated maximum foam run for the particular foam used.

Figure 1A:
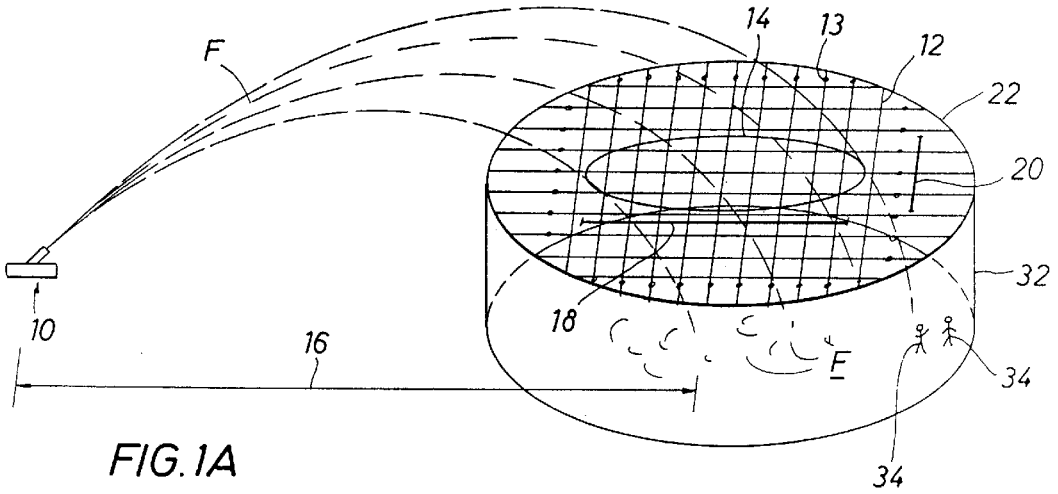
FIGS. 1A and 1B illustrates an empirical method for 20 determining a nozzle footprint, and footprints so determined.
Figure 1B:
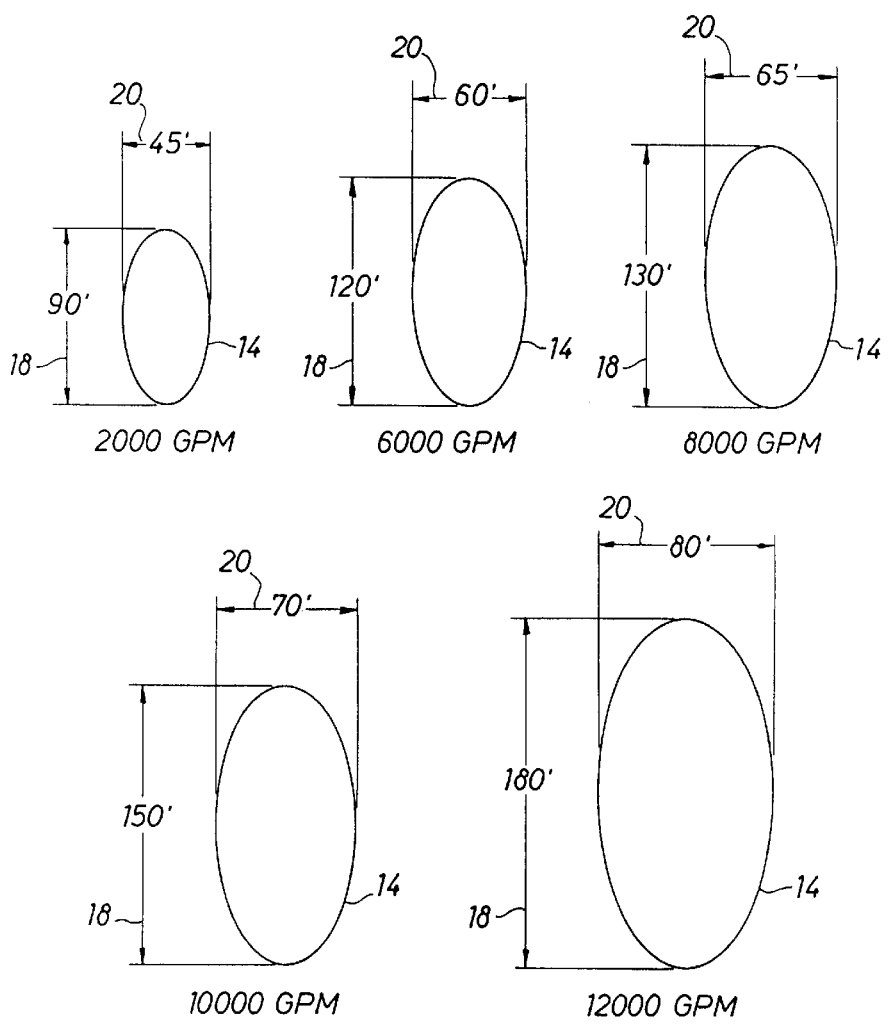

FIGS. 1A and 1B relate to the empirical method for determining the footprint of a nozzle. As illustrated in FIG. 1A, nozzle 10 is a standard distance 16 from an empty tank 32. Individuals 34 stand in the bottom of the empty tank. A grid of lines 12 are stretched across the top of the tank each line bearing flags 13. The lines may be stretched across the top of the tank laterally and longitudinally in approximately 10 foot intervals. Foam F is shot from nozzle 10. The individuals 34 on the ground in the tank observe the perimeter of the footprint 14 by observing which lines 12, more easily indicated by means of flags 13, are being touched by the perimeter of the foam as it passes through the rim 22 of tank 32.

FIG. 1B illustrates empirically determined footprints 14, the general length 18 and breadth 20 indicated for different nozzles using a particular foam.

Figure 2B:
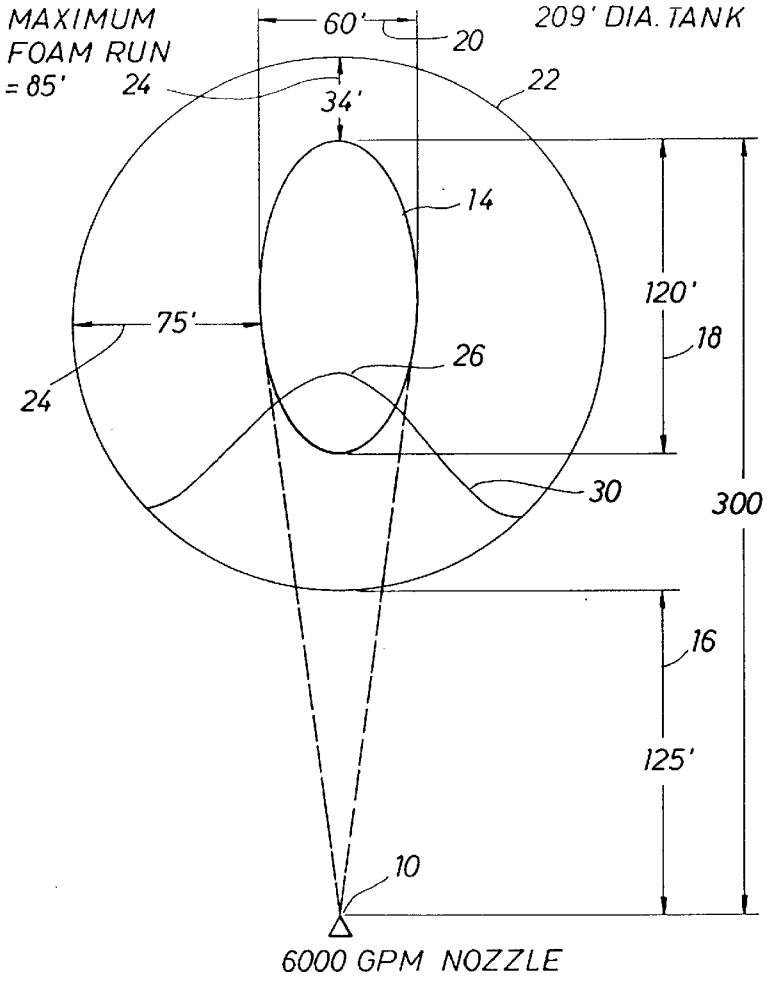
FIGS. 2A through 2T illustrate applications of the inventive method for different nozzles having different footprints and applied to different diameter tanks.
Figure 2A:
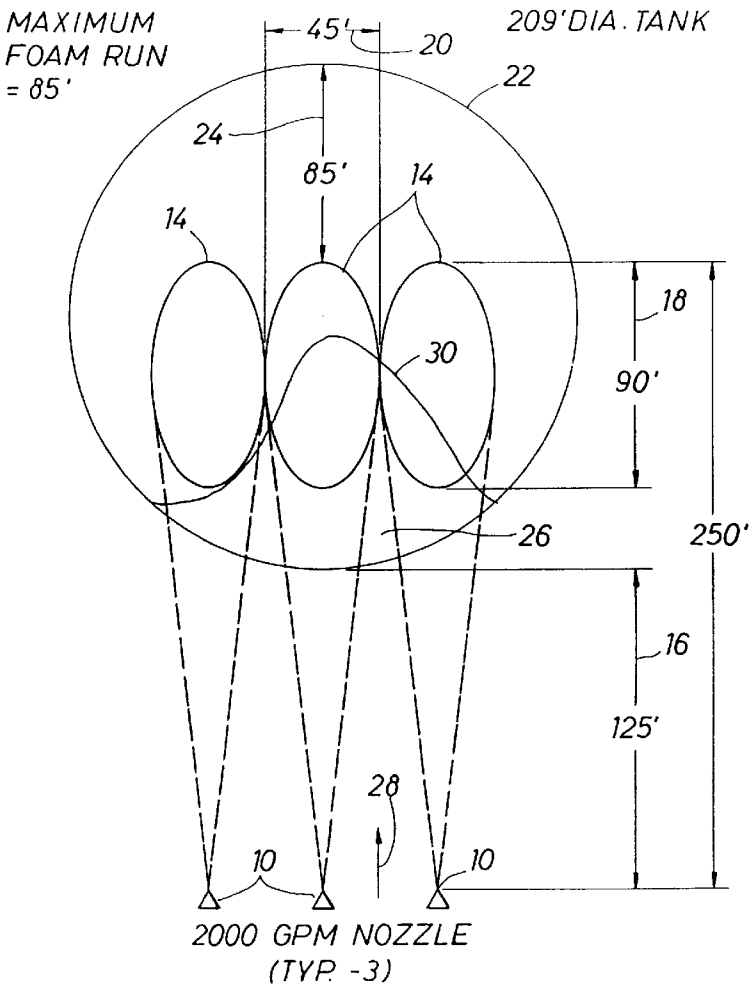
Figure 2D:
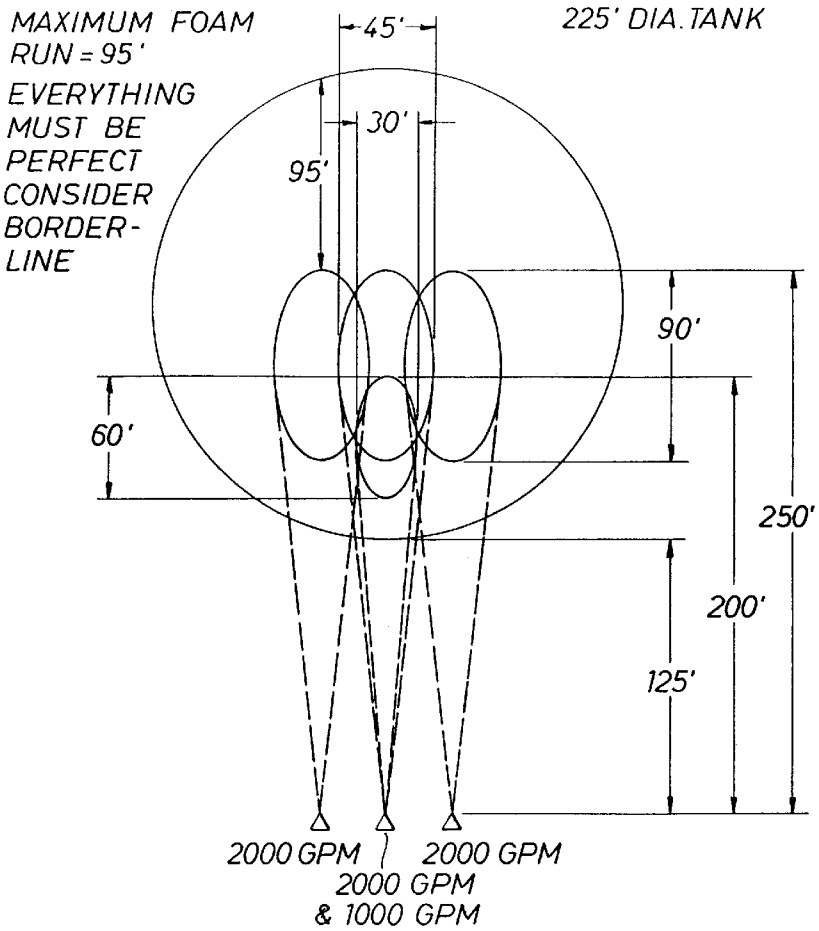
Figure 2C:
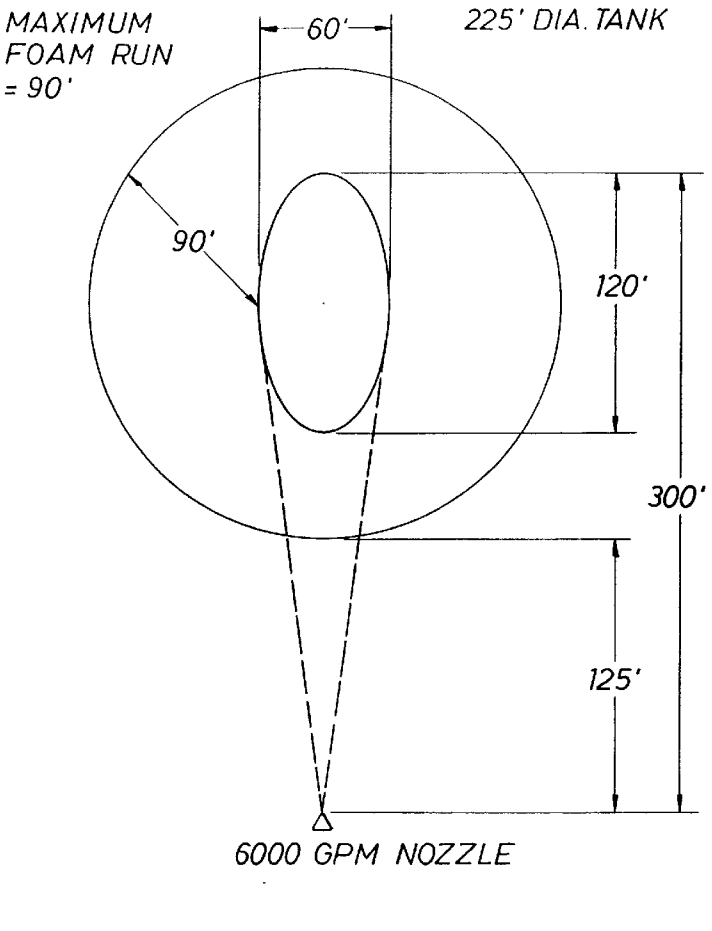
Figure 2F:
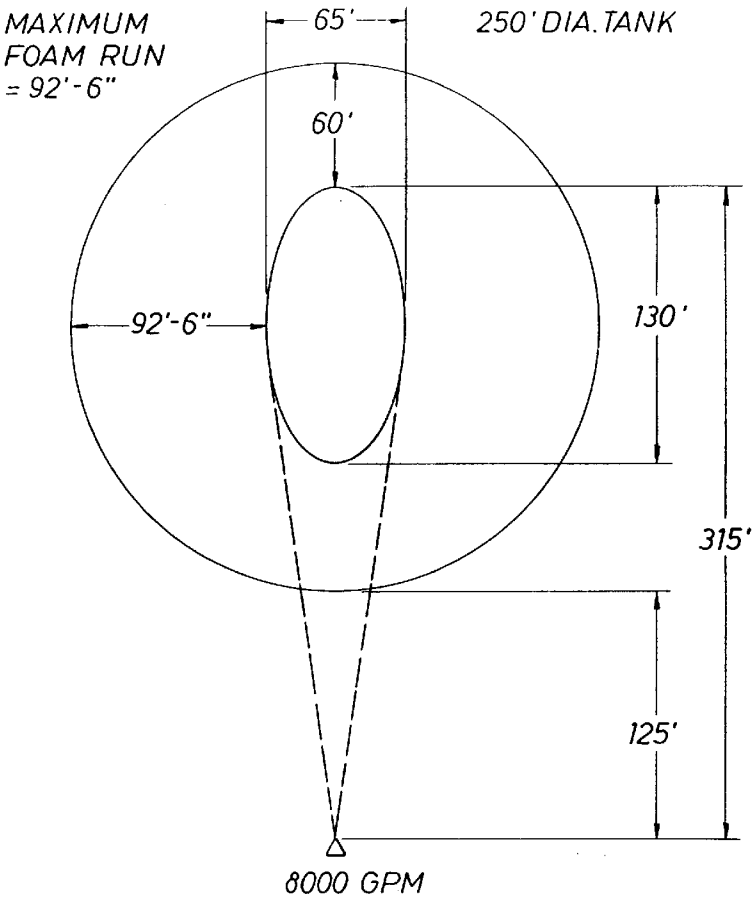
Figure 2E:
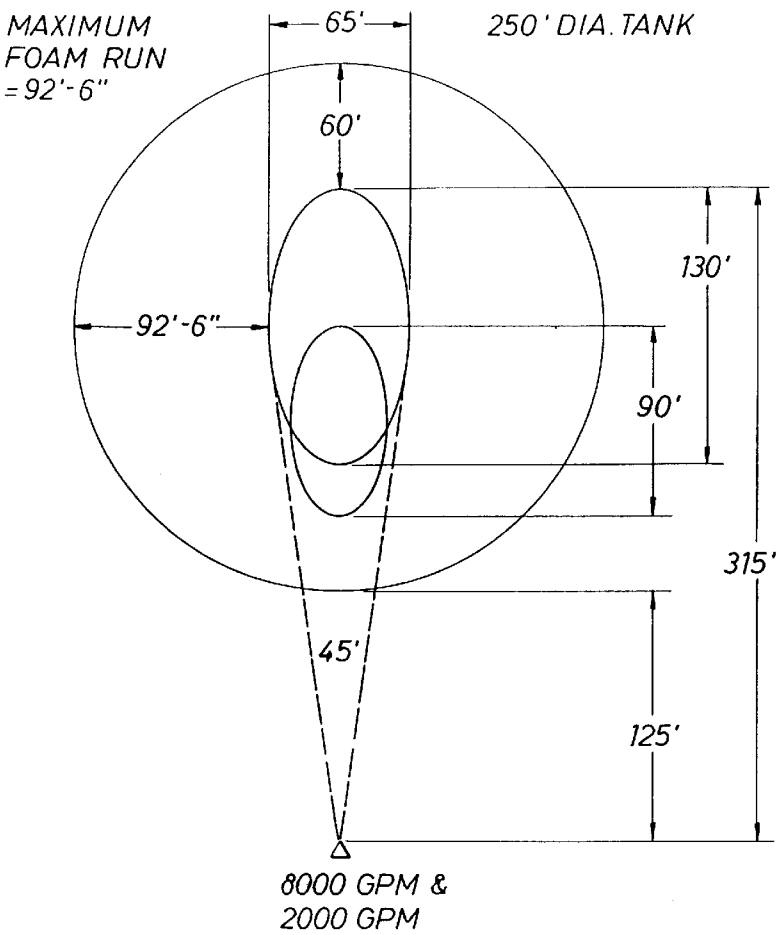
Figure 2H:
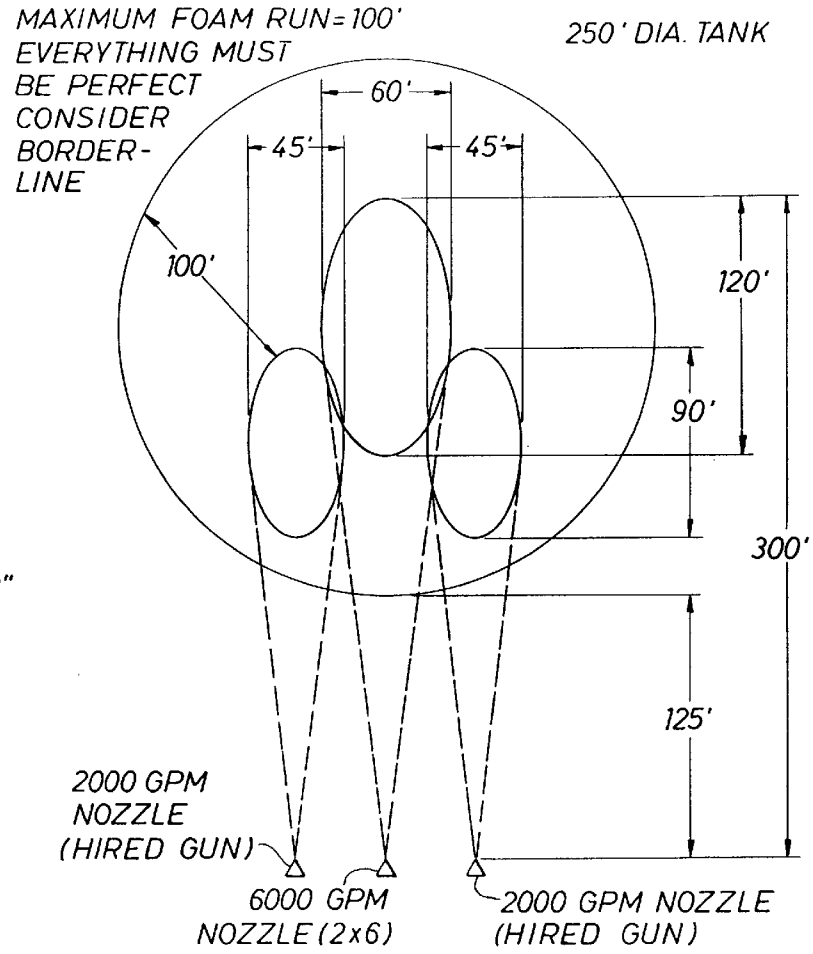
Figure 2G:
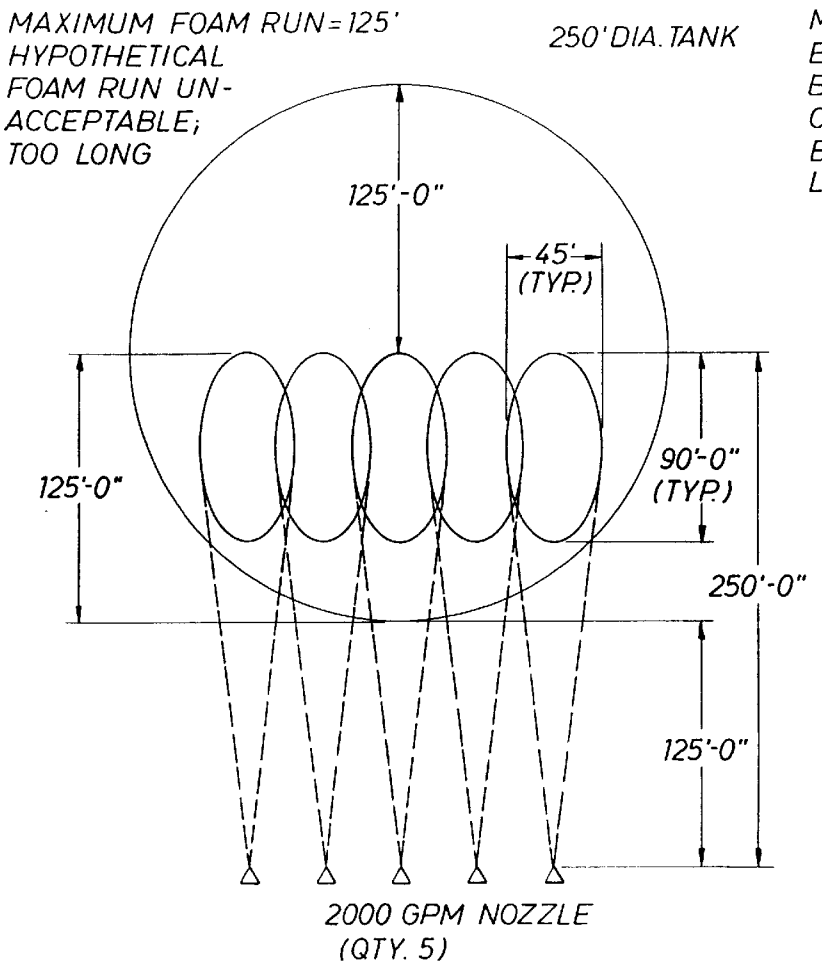
Figure 2J:
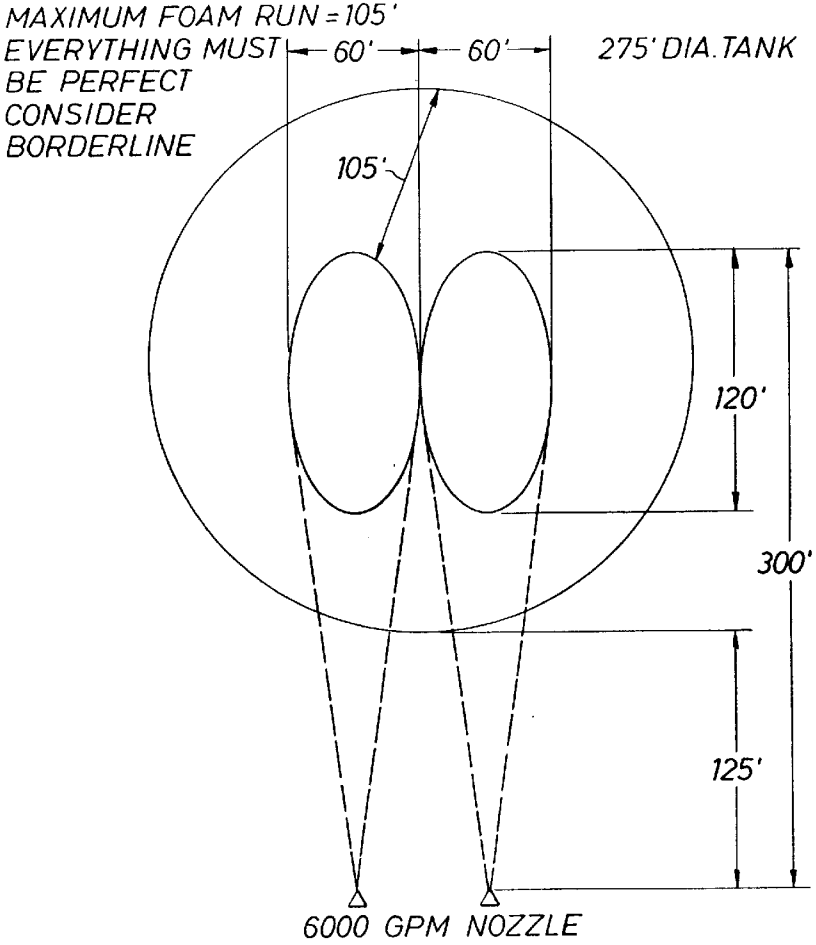
Figure 2I:
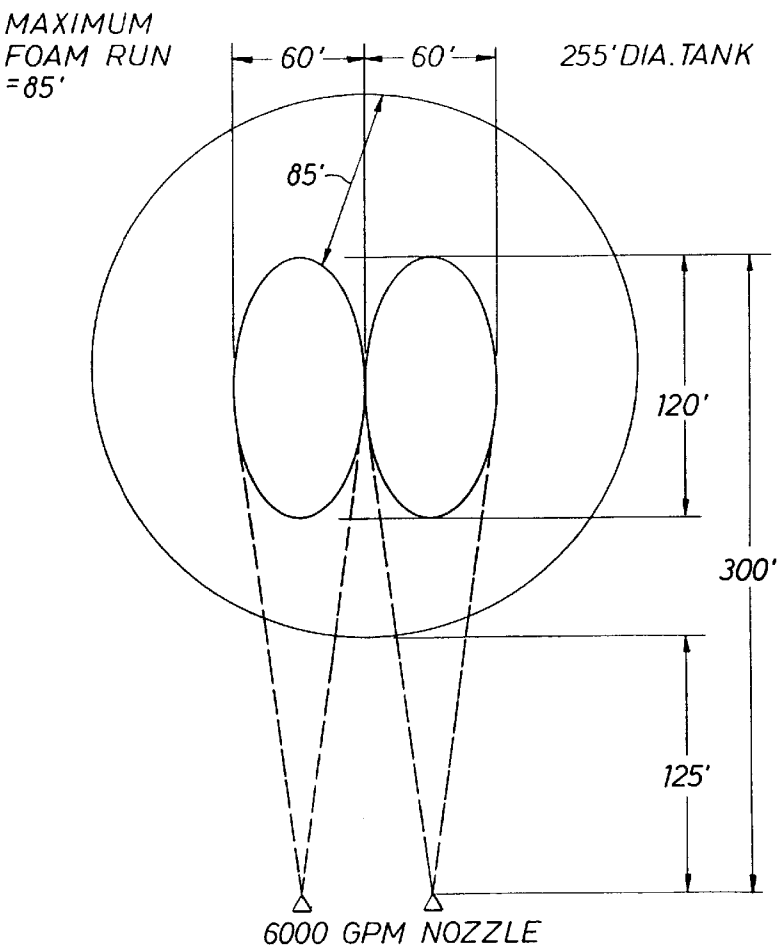
Figure 2L:
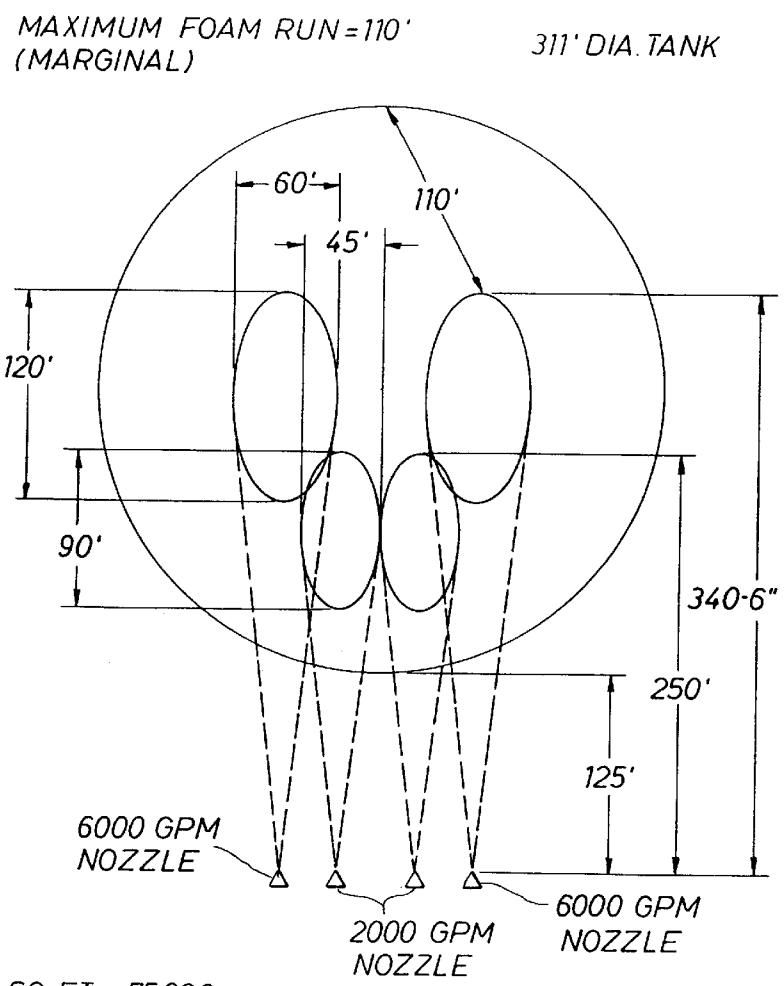
Figure 2K:
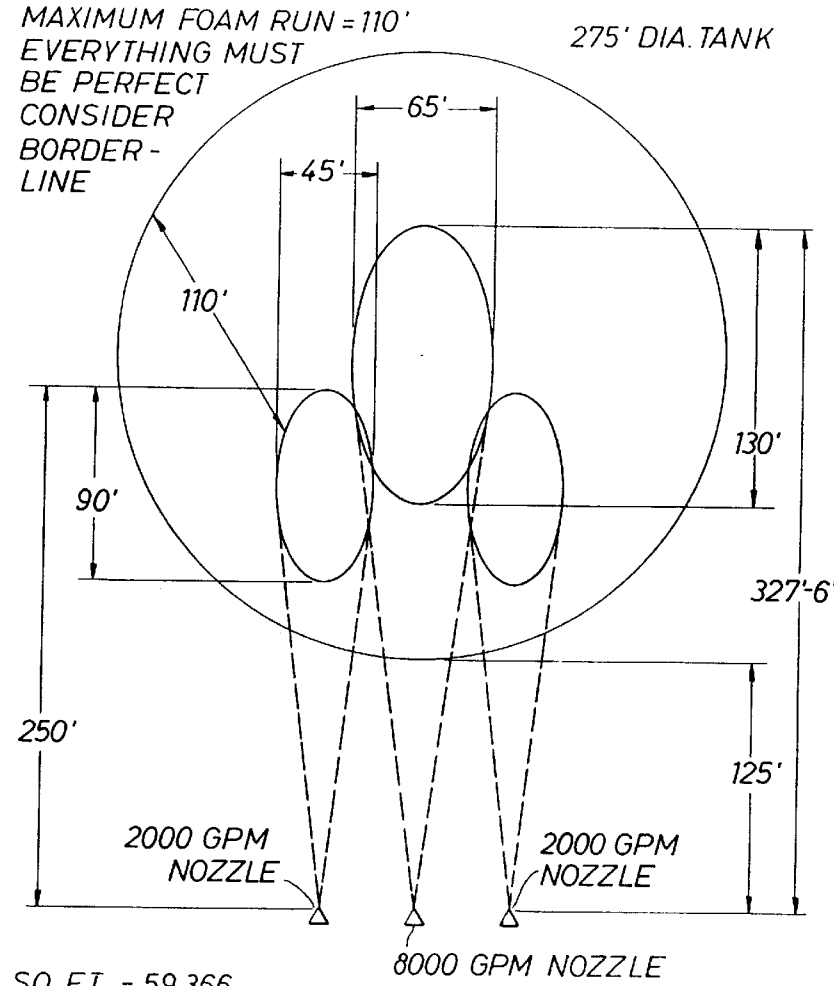
Figure 2N:
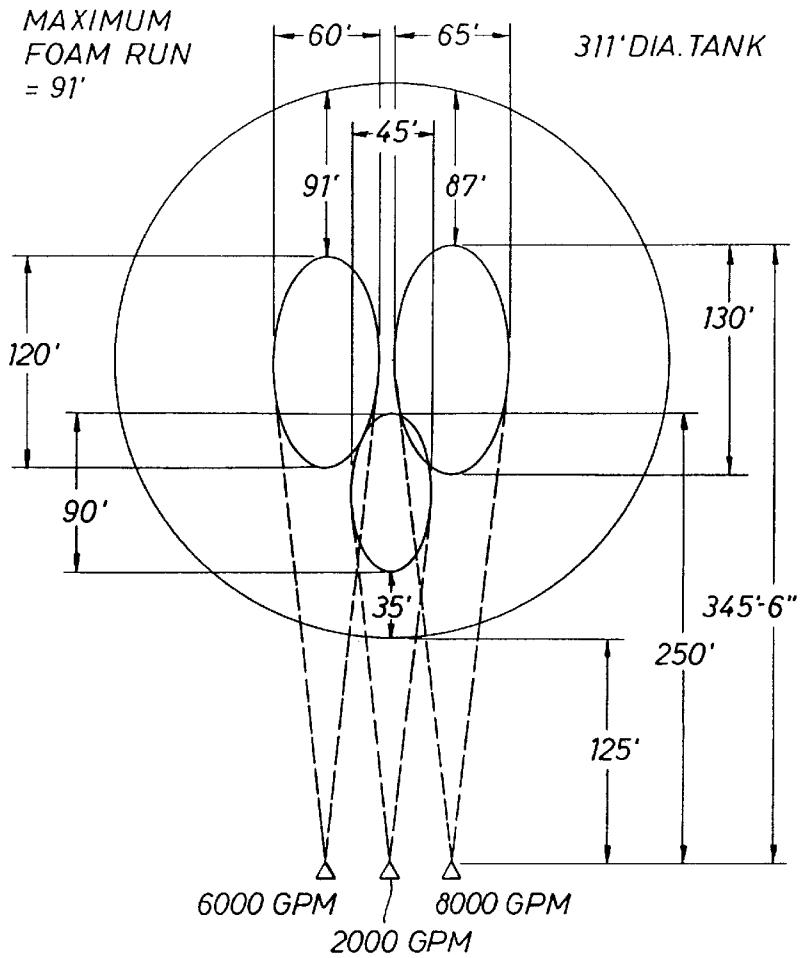
Figure 2M:
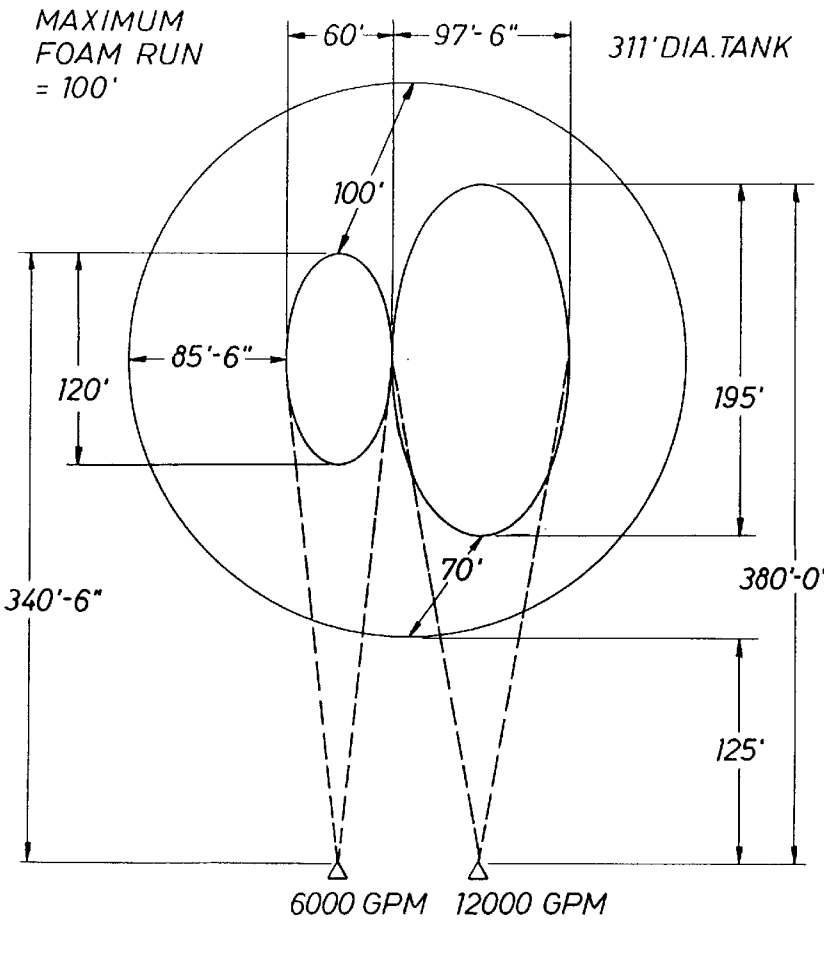
Figure 2P:
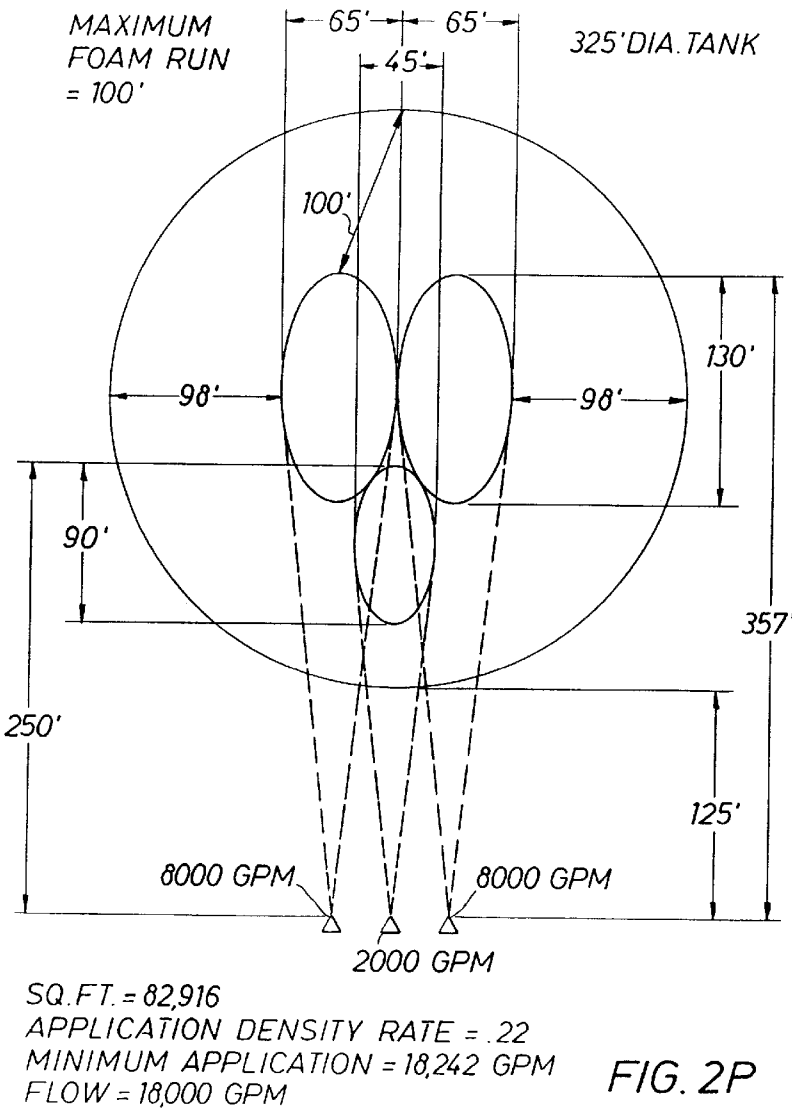
Figure 2O:
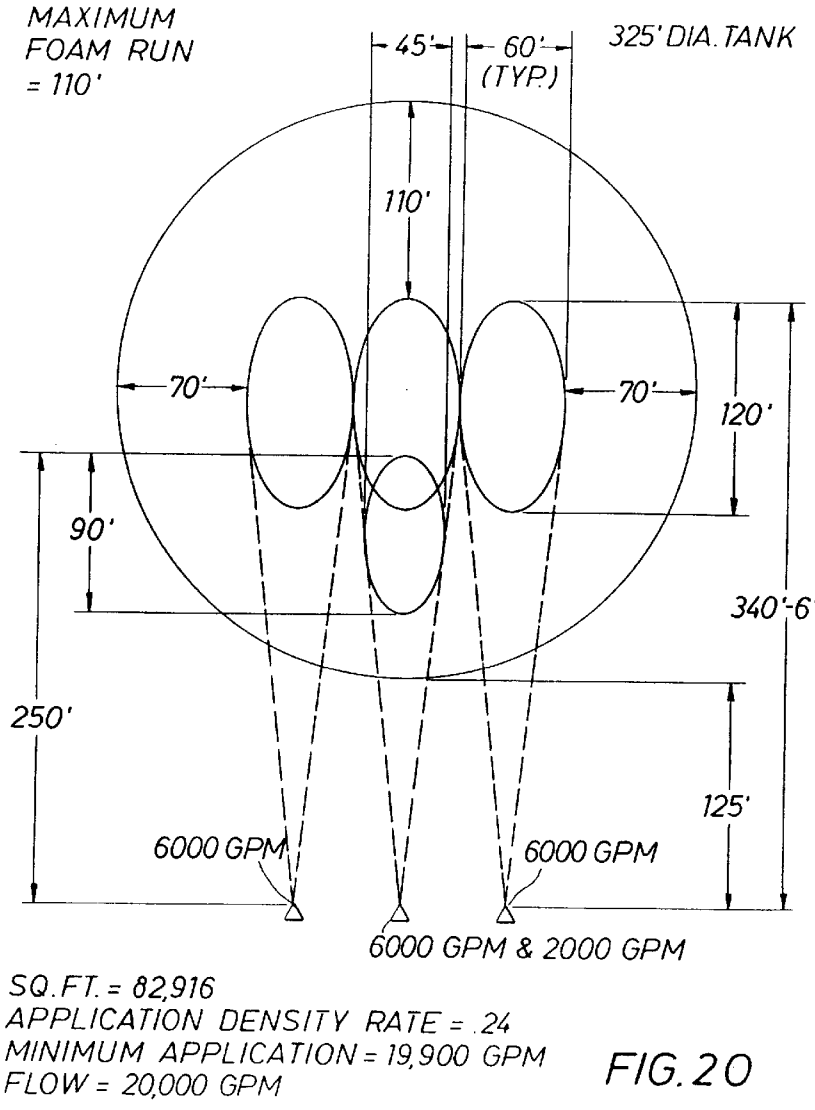
Figure 2R:
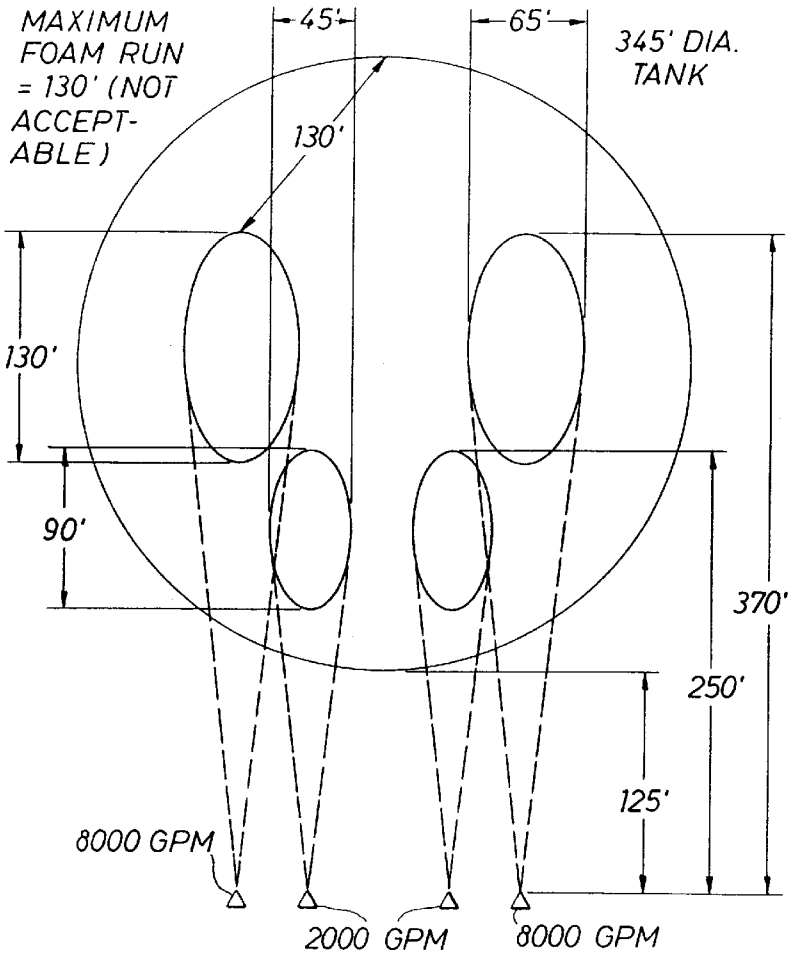
Figure 2Q:
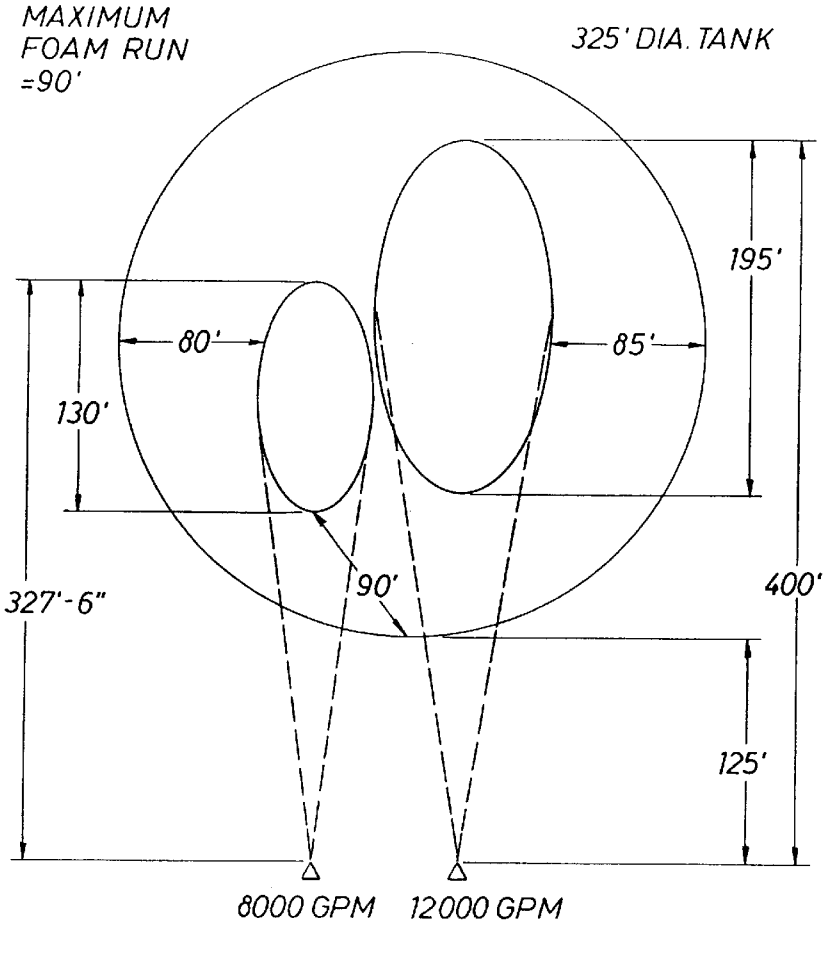
Figure 2T:
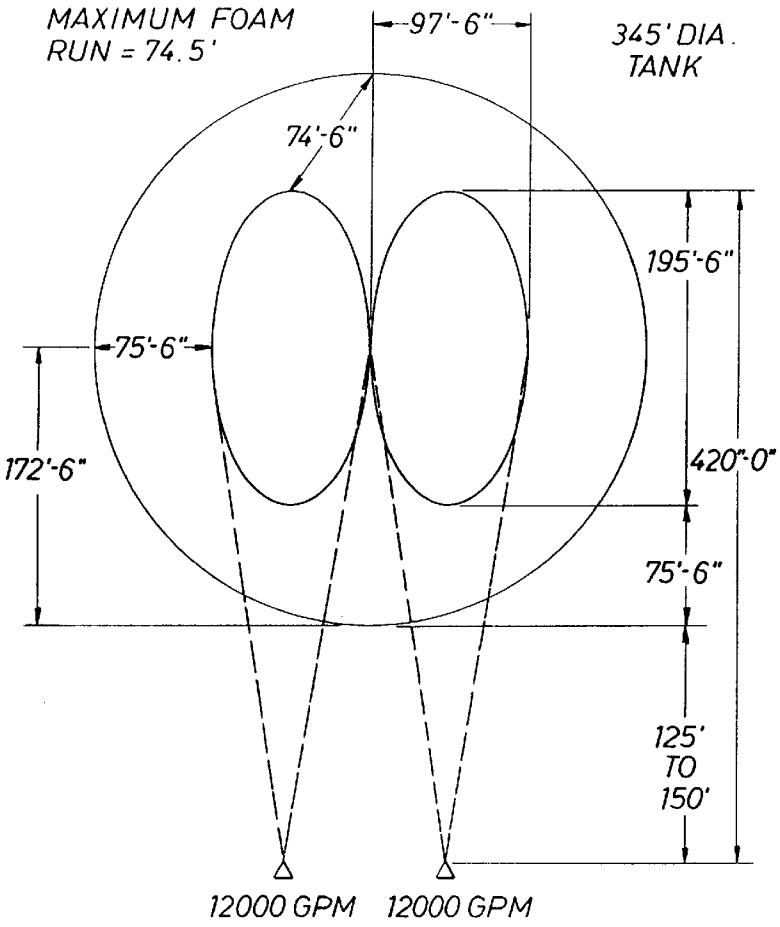
Figure 2S:
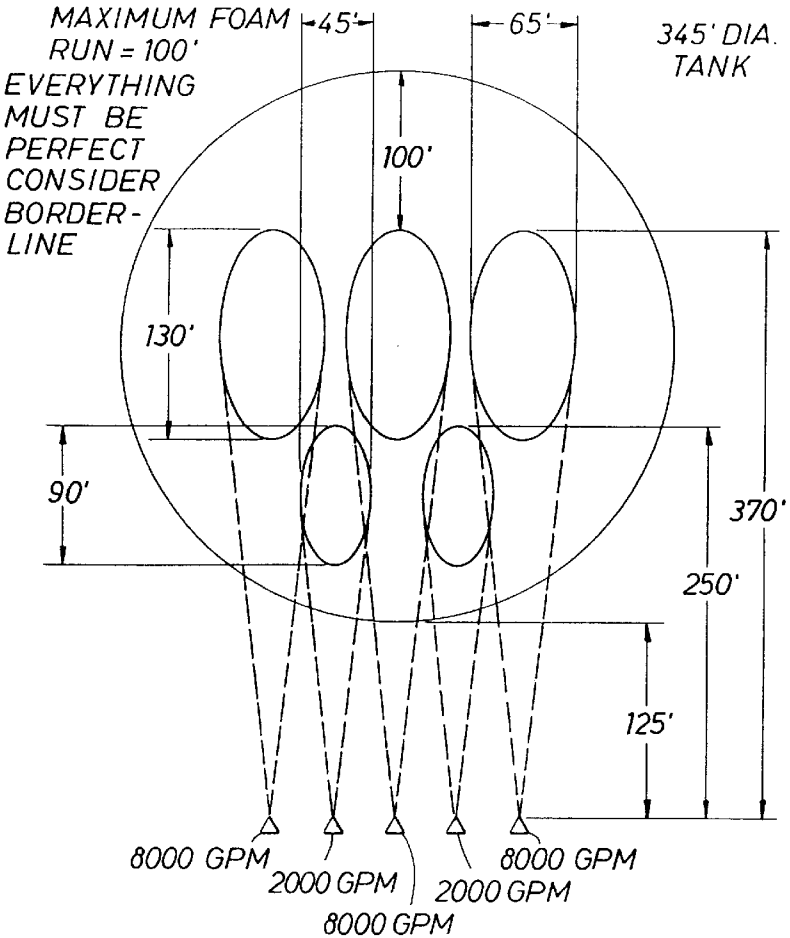

In the example of FIGS. 2A through 2T the maximum foam run for the particular foam used was approximately 100 feet.

More particularly, FIG. 2A illustrates a configuration for a 209 foot diameter tank 32. Three nozzles 10 are deployed and aimed. The nozzles are deployed distance 16 away from tank 22, which comprises a standard 125 feet. Footprints 14, empirically determined to be associated with particular 2,000 gpm nozzles 10, yield a concentration of foam around an estimated sweet spot area 26, more particularly defined by estimated boundary 30, while requiring a maximum foam run 24 of only 85 feet. It can be seen that a footprint of a 2,000 gpm nozzle has a general maximum breadth 20 of approximately 45 feet and a general maximum length 18 of approximately 90 feet.

FIG. 2B shows the application of the same method to the same 209 foot diameter tank 32 utilizing one 6,000 gpm nozzle 10. Again, the nozzle is deployed a standard distance 16 of 125 feet from tank wall 22. Predicted sweet spot 26 receives a significant foam concentration and the maximum foam run required can be held to 75 feet.

FIGS. 2C through 2T provide examples similar to FIGS. 2A and 2B.

FIGS. 3A through 3C illustrate an improved system for the extinguishing of tank fires including crude and high vapor pressure flammable liquid tank fires. In FIG. 3A, tank T is shown having liquid surface LS. Lines 41 bring a source of fluid, preferably water, to nozzles 42. Nozzles 42 are illustrated as staged approximately 75 ft. away from tank T. Nozzles 42 are preferably oscillating monitors that can distribute the fluid, such as water, by paths 43 against exterior wall portions of tank T. A height 40 is illustrated indicating a height above the liquid surface LS of the liquid in tank T to which the fluid should be applied. Preferably, height 40 is approximately 3 feet.

FIG. 3B illustrates a top view of tank T showing footprint F. Footprint F is the footprint generated by some source or sources of a foam fire-extinguishing medium. A single footprint is shown in FIG. 3B and discussed herein. As mentioned above, it should be understood that "footprint" F, here, could comprise a composite or multiplicity of footprints from a variety of sources of foam, such as illustrated in FIGS. 2. FIG. 3B illustrates footprint F having a foam run 44 of 90 feet on two sides and a foam run 46 of 60 feet on two other sides. Common commercial foam today may be expected to have a foam run of up to 100 feet. Thus, footprint F would be expected to yield a foam run such that foam covers all of liquid surface LS and reaches all of the sides of tank T. In particular, if liquid in tank T comprises crude or high vapor pressure liquid, it is advisable (1) to apply foam in footprint F to liquid surface LS at the specified minimum gallons per minute for the minimum time; and (2) to apply in addition fluids such as water to cool portions of the walls of tank T. These portions would especially comprise a level around and slightly above the liquid surface LS level. An important portion of tank wall to cool first is the portion to which the foam has the longest run. In the illustration of FIG. 3B, the portion that might be most advantageously cooled first would be the portion in the direction 44 of foam run.

FIG. 3C illustrates further an improved method of extinguishing fire in a tank, including crude and high vapor pressure flammable liquid. Footprint F is illustrated as established on liquid surface LS in tank T by means of nozzle 48. (Again, a single footprint is illustrated for convenience.) Sources of additional fluid 42, such as oscillating nozzles, are illustrated staged around tank T such that they can throw additional fluid, such as water, along paths 43 against exterior side portions of the wall at a level at and slightly above the height of liquid surface LS. Foam from nozzle 48 is shown having path 45. In addition to foam nozzle 48 and fluid nozzles 42, an additional dry powder nozzle 54 is shown in FIG. 3C, alternately staged in two positions. Dry powder nozzle 54 is shown stationed on platform 52 or boom 50. Dry powder nozzle 54 may also include foam capability. Dry powder nozzle 54 is advantageously staged on the frontside of the tank. (Again, the frontside of the tank refers to the upwind side of the tank while the backside of the tank refers to the downwind side of the tank.)

If the footprint of foam creates a relatively equal foam run around the sides of tank T, the sides of the tank that would preferably be cooled first, by the application of liquid to exterior wall portions of the tank, would be the backside portion of the tank wall. In FIG. 3C BS indicates the backside portion of the tank wall. FS indicates the frontside portion of the tank wall in the embodiment illustrated.

The foregoing disclosure and description of the invention are illustrative and explanatory thereof. Various changes in the size, shape and materials as well as the details of the illustrated construction may be made without departing from the spirit of the invention.

I claim:

1. A method for extinguishing tank fires including crude and high vapor pressure flammable liquid tank fires, comprising:

configuring one or more remote nozzles with respect to a tank to apply foam to cover a liquid surface in a tank, the configuration taking into account a predicted footprint pattern for a nozzle and a predicted foam run; and applying fluid against at least a portion of the exterior tank wall at a height at and slightly above the liquid level to cool the tank wall.

2. The method of claim 1 wherein the step of applying fluid comprises predicting the largest foam run and applying fluid against a portion of the tank wall having the longest predicted foam run.

3. The method of claim 1 wherein the step of applying fluid comprises applying fluid against a backside portion of the tank wall.

4. The method of claim 1 wherein the step of applying fluid comprises applying fluid circumferentially around the tank wall.

5. A method for extinguishing tank fires including crude and high vapor pressure flammable liquid tank fires, comprising:

applying foam to a liquid surface in a tank in a footprint such that the foam run covers the liquid surface; and applying fluid against a tank wall portion extending from the liquid level to approximately 3 feet above the liquid level, to cool the tank wall.

6. The method of claim 1 wherein the step of applying fluid includes throwing water on the tank wall from an oscillating monitor.

7. The method of claim 1 that includes positioning a dry powder nozzle above a tank wall.

8. The method of claim 7 wherein the step of positioning includes positioning the nozzle above a front portion of the tank wall.

9. The method of claim 7 wherein the step of positioning includes a foam and dry powder nozzle above a tank wall.

* * * * *